United States Patent [19]

Kretz

[11] Patent Number: 4,894,935

[45] Date of Patent: Jan. 23, 1990

[54] STEAM BOARD WITH ADJUSTABLE GARMENT SUPPORT

[76] Inventor: David C. Kretz, 3533 Heather Ridge Dr. NE, Cedar Rapids, Iowa 52402

[21] Appl. No.: 332,045

[22] Filed: Apr. 3, 1989

[51] Int. Cl.[4] ..... D06C 3/00

[52] U.S. Cl. ..... 38/137; 38/104; 223/69; 223/DIG. 4; 248/214

[58] Field of Search ..... 248/214; 38/102, 104, 38/112, 137; 223/69, 70, DIG. 4, DIG. 2

[56] References Cited

U.S. PATENT DOCUMENTS

| | | | |
|---|---|---|---|
| 465,864 | 12/1891 | Krause . | |
| 2,599,199 | 6/1952 | Roberts | 223/69 |
| 2,854,178 | 9/1958 | McDowall et al. . | |
| 3,066,839 | 12/1962 | Dosal . | |
| 3,264,755 | 8/1966 | Moore . | |
| 3,442,426 | 5/1969 | Kannegiesser et al. . | |
| 3,477,155 | 11/1969 | Feld et al. . | |
| 3,486,668 | 12/1969 | Feld et al. | 223/69 |
| 3,752,373 | 8/1973 | Smith . | |
| 3,989,213 | 11/1976 | Allen | 248/214 |
| 4,123,024 | 10/1978 | Levy | 248/214 |
| 4,303,183 | 12/1981 | Schlemon . | |
| 4,592,497 | 6/1986 | Georges . | |
| 4,613,066 | 9/1986 | Saucy . | |

*Primary Examiner*—Andrew M. Falik

*Attorney, Agent, or Firm*—Simmons, Perrine, Albright & Ellwood

[57] ABSTRACT

A board is vertically mountable to a wall or door and features an upwards extending support structure to which a garment hanger support bracket is attached. The garment hanger support bracket is itself vertically adjustable to permit hangers to be supported relatively higher or lower with respect to the board. A vertical adjustment of the bracket consequently allows respectively longer or shorter garments to be hung in a substantially centered position in front of the board. In addition the garment hanger support bracket features a plurality of vertically spaced hanger support recesses which allow a garment to be vertically relocated during a steaming operation without the need to vertically readjust the garment hanger support bracket itself. This latter feature permits a garment to be vertically shifted to bring wrinkles in upper and lower portions of the garment to a convenient working height.

7 Claims, 2 Drawing Sheets

FIG 1
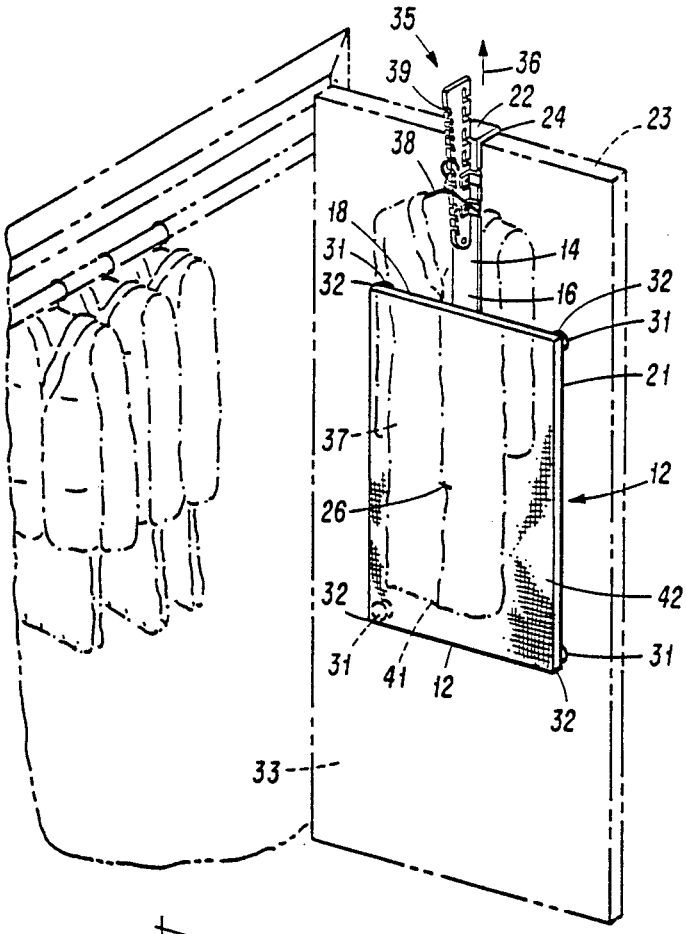
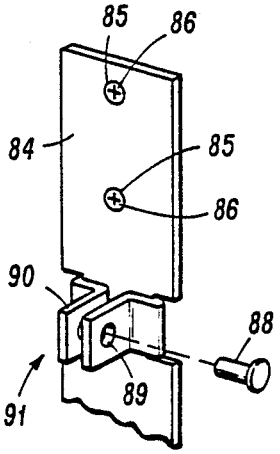
FIG 4
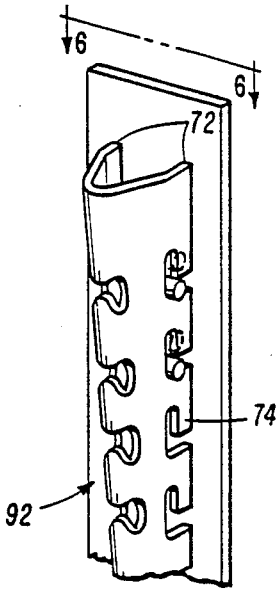
FIG 5
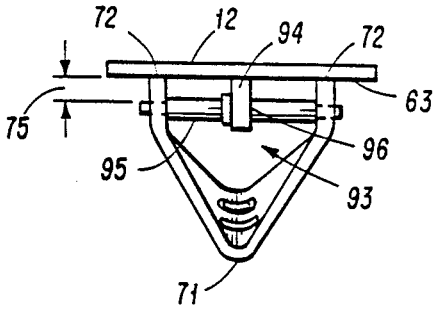
FIG 6

STEAM BOARD WITH ADJUSTABLE GARMENT SUPPORT

BACKGROUND OF THE INVENTION

1. Field of the Invention

This invention relates to generally to apparatus for steaming garments and particularly to a fixture for supporting garments which are to be steamed by means of a hand-held steamer.

2. Description of the Prior Art

In the recent past, so-called "hand steamers" for home use have been made commercially available. Such hand-held steamers are typically powered by standard house current like many other hand-held electric home appliances. The hand-held steamer, typically of lightweight construction, includes an electrical heating element and a reservoir for holding a quantity of water. The water is converted to steam during the operation of the hand-held steamer. A steam outlet of the steamer is directed against wrinkled fabric portions of a garment. The steam tends to restore the natural shape of the garment.

Though hand-held steamers have proven to be valuable home appliances for removing unwanted wrinkles from most garments, the effectiveness of their use is sometimes hampered in the absence of an efficient way to hold a garment to be steamed. In many instances, the need to quickly restore a suit, coat, jacket or skirt comes up unexpectedly, when the garment is taken from the closet, and time to meet a busy schedule is running short. For example, when on a Sunday afternoon, garments are packed for an important Monday morning business trip. In these types of situations, the immediate availability of a practical work site for steaming the garments becomes invaluable.

A garment support used by some commercial cleaning and pressing establishments in conjunction with hand-held steamers provides a wall-mounted backplate. At the top and center of the backplate, a clamping and hanger linkage provides for the temporary suspension of a garment either by clamping the garment against the backplate, or as a structure for holding a hanger in suspension while a garment is steamed. The garment clamping linkage is activated by a foot switch which is coupled through a cable connection to the clamp at the top of the plate.

The described support for garments during steaming operations may be useful for commercial operations. However, the complexity of the installation with the foot switch mechanism and the fixed height at which the garment holder is mounted render such installation in a home undesirable. Since hand-held steamers are typically used only occasionally in the home, and ready availability and unobtrusive storage of equipment used with such steamers are desirable, commercial installations have failed to meet the needs of home users of hand-held steamers.

Various other devices for steaming garments are known which typically do not contemplate the use of a hand-held steamer. Instead, they provide a support for specific garments and permit steam to be introduced into the garment, and to be distributed somewhat uniformly from the inside of the garment through virtually all of its material, while the garment is supported by a frame. The frame approximates the shape of a person wearing the garment. While such fixtures or garment supports may be practical in their specific applications, the specificity of their applications or the generally increased consumption and release of steam as the result of steaming a garment in its entirety makes these appliances more suitable for larger volume use, such as in commercial cleaning and steaming applications, as opposed to occasional home use.

Other supports, such as ironing boards or table surfaces are sometimes used in conjunction with hand-held steamers. Ironing boards are used because of their availability in many households in which hand-held steamers have come into use. Ironing boards typically occupy a stow-away place in a closet and are quickly set up. Table surfaces are sometimes used because of their convenient availability in emergencies created by time pressures of current lifestyles. Horizontally disposed supports, however, have been found to be less than ideal for removing wrinkles from garments with hand-held steamers.

SUMMARY OF THE INVENTION

It is therefore an object of this invention to provide a workstation for steaming garments, which workstation can be unobtrusively stored and, yet, be readily available when needed.

It is another object of the invention to provide such a workstation in form of a steam board of a size suitable for ready storage, and to provide a practical, adjustable garment support for allowing garments of various sizes to be suspended in a position that the wrinkled portions are located in superposition with a work area of the steam board. Such suspension of garments frees up both hands of the person intending to use a hand-held garment steamer, allowing garments to be stretched and rearranged with one hand during the steaming operation while holding the steamer in the other hand.

It is a further object of the invention to provide protection for wall or panel areas which make desirable workstations areas for steaming wrinkles from garments.

Another object is to provide for a convenient, vertically adjustable suspension of garments to permit the garments to hang under their own weight, thereby facilitating the use of a hand-held garment steamer at a convenient height without a need of excessive stooping or reaching.

These and other objects and advantages are realized by a new and improved steam board with an adjustable garment support. An elongate mounting bracket is attached at one end to a central, upper area of a back surface of a steam board of essentially rectangular shape. The mounting bracket extends in the plane of the steam board away from the steam board and is oriented such that a longitudinal projection of the steam board essentially passes through the centroid of the board. Thus, a mounting implement on the upper end of the mounting bracket permits the steam board to be suspended in a vertically stable position by the mounting bracket, such that the steam board rests essentially parallel adjacent a wall, panel or door to which the mounting bracket may be attached. A garment hanger bracket is provided with a first implement for adjusting the position of the hanger bracket toward and away from the steam board along the length of the mounting bracket, and with a second implement for suspending a garment hanger at various shifted positions with respect to the steam board.

The first adjustment implement allows the garment hanger bracket to be moved away from or toward the steam board, depending on whether respectively longer or shorter garments are to be steamed. The second adjustment implement permits a person to quickly reposition a garment with respect to the steam board during the steaming operation to move wrinkled portions of the garment to a conveniently accessible working height in front of the steam board.

BRIEF DESCRIPTION OF THE DRAWING

Various features and advantages of the invention are better understood when the following detailed description of the invention is read in reference to the appended drawing, wherein:

FIG. 1 shows an overall view of a steam board as a particular embodiment of the invention relative to a typical environment to which its advantages apply;

FIG. 4 shows an alternate embodiment of a mounting structure at an upper end of a mounting bracket in distinction over the mounting structure shown in FIG. 2;

FIG. 5 depicts an alternate embodiment of the garment hanger bracket shown in FIGS. 1, 2 and 3; and FIG. 6 is a top view of the garment hanger bracket of FIG. 5, showing a support structure extending from the front surface of the mounting bracket.

DETAILED DESCRIPTION

Figure 3:
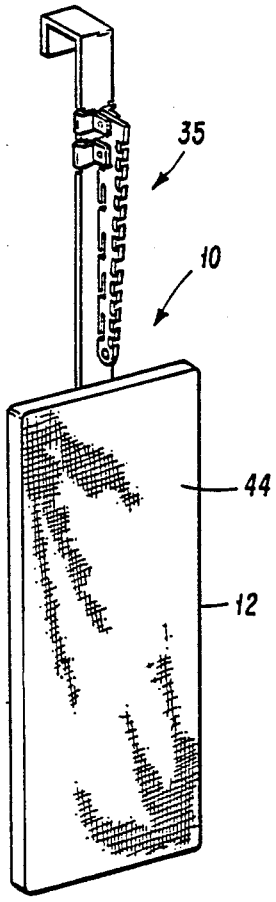
FIG. 3 shows the steam board of FIGS. 1 and 2 in an assembled condition in which a garment hanger bracket is disposed in a lowermost position.

Referring to FIG. 1, there is shown a steam board assembly, generally referred to by the numeral 10, depicting a preferred embodiment of this invention. The steam board assembly 10 is shown in relationship to a wardrobe, depicted in phantom lines and designated generally by the numeral 11, as an illustrative example of an environment with respect to which certain features of the invention are more readily explained. The steam board assembly 10 includes a generally rectangular board 12, and an elongate mounting bracket 14 which is centrally attached with a first, lower end portion 16 adjacent an upper edge 18 to a back surface 21 of the board 12. A second, upper end portion 22 of the mounting bracket 14 is in its preferred embodiment formed to fit smoothly over the top of a vertically disposed panel, such as a closet door 23 shown here in phantom lines. A short, second ledge 24, formed downward at the very end of the end portion 22 permits the end portion 22 to remain securely in position over the door 23, as shown in FIG. 1. The formed end portion 22 provides, consequently, a convenient means for attaching the steam board assembly 10 to an open door 23, provided such door is accessible from above.

Since the central attachment of the mounting bracket 14 to the board 12 is desirably symmetrical such that the downwardly extended length of the mounting bracket 14 passes in essence through, or immediately past, the centroid 26 of the board 12, the steam board assembly 10 becomes suspended in a vertically stable position. Feet 31 of a resilient material, such as rubber, are attached to the back surface 21 of the board 12. In the preferred embodiment of the invention, there are four of such feet 31, each respectively attached adjacent a different one of the four corners 32 of the board 12. Also, the feet 31 cause the back surface 21 of the board 12 to rest spacedly in parallel with the door 23 without marring its surface 33.

Figure 2:
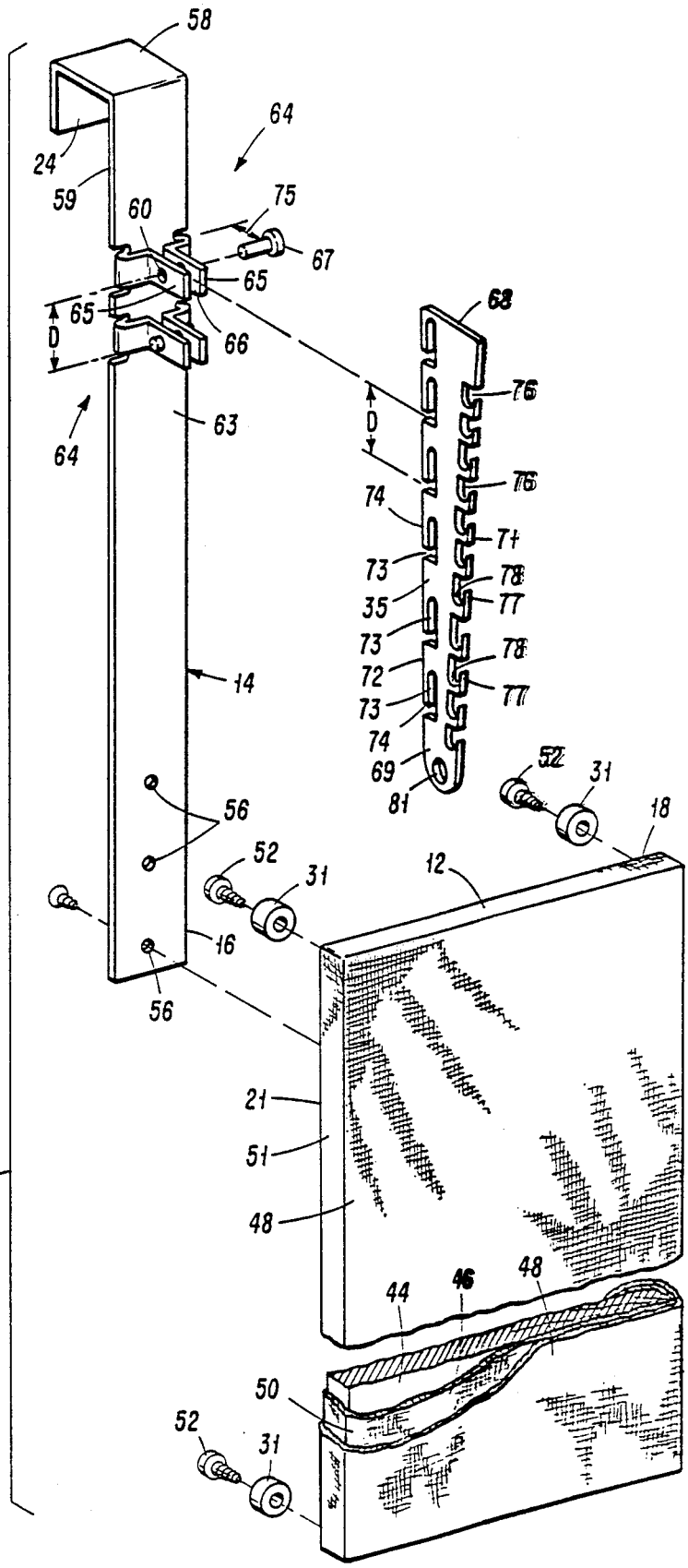
FIG. 2 is an exploded view of the steam board of FIG. 1, showing structural details of the preferred embodiment of the invention, including a mounting structure at a top end of the mounting bracket for a suspension of the steam board from the top of a panel or closet door.
Figure 3:
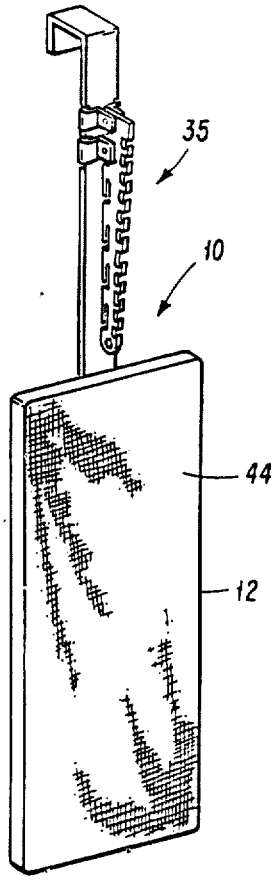
Figure 2:
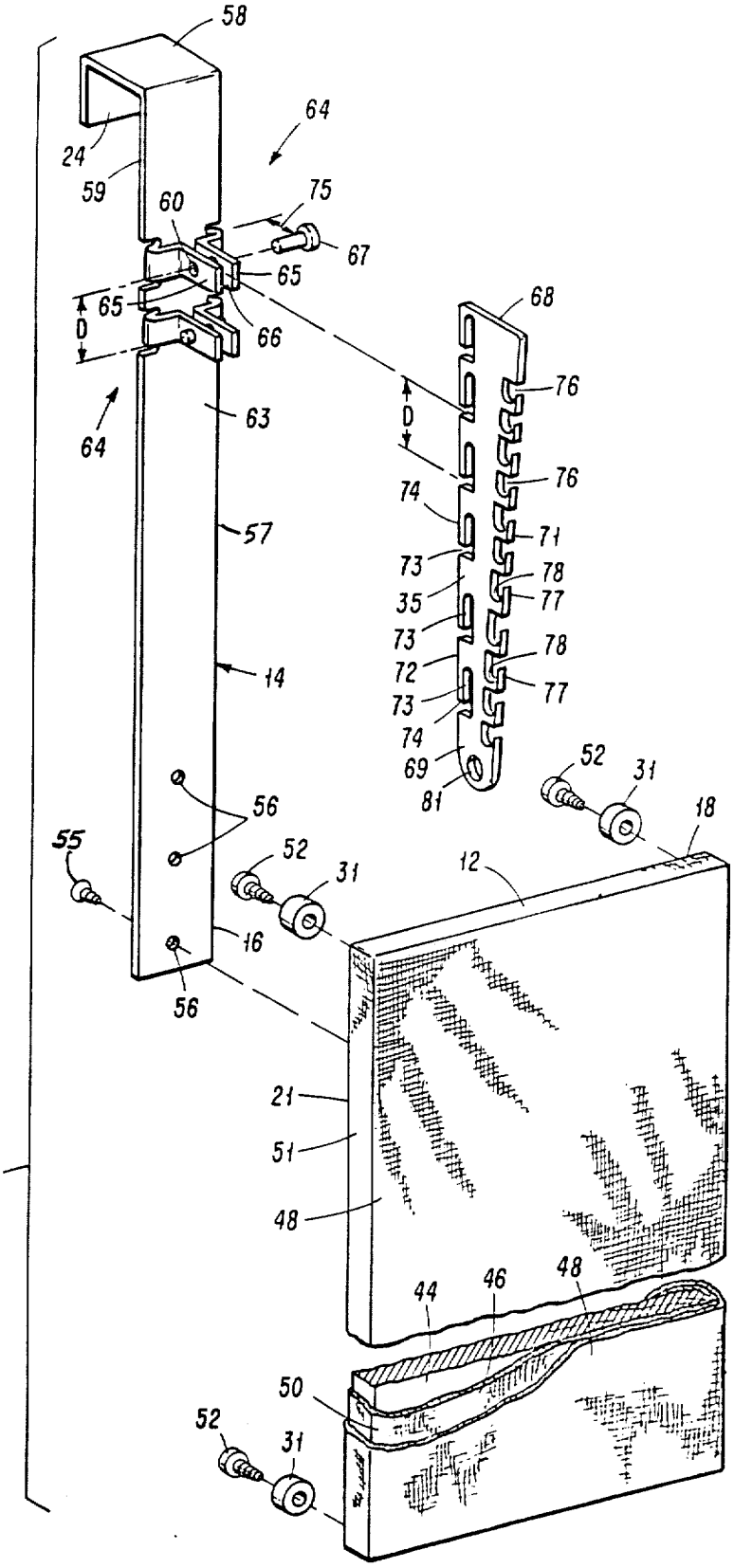

A garment hanger bracket 35 is shown in an upper position, having been adjusted in the direction of an arrow 36 to extend even above the door 23. A long garment 37, such as a typical woolen overcoat or a dress, is shown in FIG. 1 in phantom lines as being suspended by a hanger 38 from an upper end 39 of the hanger bracket 35. In the depicted arrangement, a hanger hook 40 of the hanger 38 is retained by the hanger bracket 35. It is to be noted that when the hanger bracket 35 is in an upwardly adjusted position and a long garment is suspended by the hanger 38 from the hanger bracket 35, a lower hem 41 of the garment 37 is positioned in alignment with the lower portion 42 of the board 12 and ready to be steamed. ;

FIG. 2 shows the generally described components of the steam board assembly 10 in greater detail. The board 12 is in the preferred embodiment of generally rectangular shape, having preferably a height of 36 inches and a width of 24 inches. The board is preferably of a water-resistant type (exterior grade) one-half inch thick plywood. The water resistant qualities are preferred because of the exposure of the surface of the board 12 to the hot steam emanating from a hand-held steamer (not shown) during the steaming of a garment, such as the garment 37 shown in FIG. 1.

A front surface or working surface 44 of the board 12 is covered by an inner sheet 46 of resilient, loosely matted, polyester material, which may be either of a woven or non-woven type. The qualities of such material have been found to allow steam which is directed against its surface to pass laterally through its material. The preferred thickness of the sheet 46 is approximately one-sixteenth to one-eighth of an inch in its uncompressed state. If a stream of steam is directed vertically into the sheet, the steam becomes deflected by the working surface 44 of the board 12 and disperses laterally through the sheet 46 to outwardly away from the working surface 44 of the board 12 in an area adjacent to the area of the board against which the stream of steam is directed. The described dispersing action has been found to enhance the action of the steam, in that the garment 37 (See FIG. 1) is being steamed from both the front and in surrounding areas of the impinging steam also from the rear by the steam escaping from the front surface 44 of the board 12.

The inner sheet 46 is covered by an outer sheet 48 of material which is, relative to the inner sheet 46, of greater strength. In the described embodiment, the outer sheet or cover sheet 48 is a woven material, such as poplin, of preferably 65 percent polyester and 35 percent cotton, and, yet, of a density which will permit impinging steam to pass through the fabric. The inner sheet is loosely fastened to the front surface 44 of the board 12. This may be accomplished in any number of ways, such as adhesively tacking the material to the surface 44, or by using tacks or staples 50 in areas of the periphery of the board 12. Since the staples 50 would be exposed to some extent to steam, the use of stainless steel or other non-corrosive material for the tacks or staples 50 would be preferred.

As shown in the broken view of the board 12 in FIG. 2, the inner sheet 46 preferably does not extend over edges, such as vertical edges 51 of the board 12, even though a wrapping structure could be used. The cover sheet 48, however, is preferably tightened over the edges, e.g., edges 18, 51, of the board 12 and stapled to the back surface 21 of the board 12. The resilient feet 31 are preferably fastened to the board 12 with screws 52 after the cover sheet 48 is attached to the board 12 as described.

The elongate mounting bracket 14 is attached as shown in FIG. 2 by screws 55. The manner of attachment of the lower end portion 16 of the mounting bracket 14 to the board 12 is one of preference. Preferably, three vertically arranged countersink mounting screws 55 are inserted through respectively formed holes 56 in the lower end 16 of the mounting bracket 14. A body portion 57 of the bracket 14 extends over a length of about 18 inches above the upper edge 18 of the board 12. The upper end portion 22 is in its preferred embodiment formed at a right angle to the length of the bracket 14, defining a support member 58. The width of the member 58 is chosen to be one and seven-eighths of an inch in its extent between a back surface 59 of the mounting bracket 14 and the retainer ledge 24, such that the member 58 fits over doors of most common widths as used in current building constructions.

A front surface 63 of the body portion 16 of the bracket features two spacedly formed hanger bracket retainer structures, designated generally by the numeral 64. The two structures 64 are spaced from each other in the direction of the longitudinal extent of the body portion 16 by a predetermined set distance "D" which corresponds to matching features in the garment hanger bracket 35, as will be described herein below. A pair of oppositely formed ears 65 extend in juxtaposition from the front surface 63 and are spaced to accept between inner surfaces 66 the thickness of the hanger bracket 35 in supporting engagement. Each of the ears 65 has an aperture 60 to accept a cylindrical retainer pin 67. The inserted retainer pin 67 may be secured in the inserted position by a small cotter pin (not shown), or by providing locking screw threads at one of the ends of the pin 67.

The described retainer structures 64 are intended to engage the hanger bracket 35. In conjunction the two retainer structures define a support for the hanger bracket 35, in that it is contemplated to engage both structures 64 for vertical and lateral support of the hanger bracket 35.

The hanger bracket 35 is an elongate, rigid member, preferably of a material which imparts rigidity and strength, such as steel or aluminum. The hanger bracket 35 has a top end 68, a bottom end 69 and front and rear surfaces 71 and 72, respectively, extending substantially the length of the bracket 35. The front and rear surfaces 71 and 72 are modified from planar surfaces or edge surfaces to serve functions, as described herein below.

In the preferred embodiment the hanger bracket 35 is a straight, elongate bar, and the front and rear surfaces 71 and 72 are front and rear edges 71 and 72, respectively, the width of the edges being defined by the thickness of the bar stock from which the hanger bracket 35 is formed. The rear edge 72 is serrated by a plurality of equally spaced "L"-shaped notches 73 which extend essentially orthogonally to the rear edge 72 into the bracket 35. All notches 73 are identical in shape, size and location with respect to the rear edge 72, to form in conjunction with the virgin surface of the rear edge 72 a plurality of spaced key members 74. The widths of the key members 74 is chosen to correspond to a gap 75 between adjacent surface portions of the front surface 63 of the mounting bracket 14 and the respective retainer pin 67 bridging the gap 75 of the retainer structure 64. It should be noted that the notches 73 are of uniform width which corresponds, except for a standard allowance configured for sliding engagements, to the diameter of the retainer pins 67. The uniform width of each notch results in the key members being rectangular in shape. Also, the spacing or pitch of the notches 73 is chosen to correspond to the predetermined set distance "D" between the two retainer structures 64 along the length of mounting bracket 14. The hanger bracket 35 becomes engageable with the retainer structures 64 by hooking two selected, adjacent ones of the key members 74 over the retainer pins 67. The retainer pins 67 thereby suspend the hanger bracket 35 at a selected distance from the board 12. The set distance or magnitude of the adjustment height of the hanger bracket 35 from the board 12 is, of course, determined by which two of the key members 74 along the rear edge 72 of the hanger bracket 35 are selected for engagement.

The rectangular shape of the key members 74 causes the retaining engagement of the key members 74 when inserted over the retainer pins 67 to be non-wedging. On the other hand, by changing the shape of the notch 73 to be wider at its opening than at its end would allow for a wedging engagement of the key in the gap 75. This wedging, engagement, while within the scope of the present invention, is not contemplated in the preferred embodiment thereof because of the added effort that would have to be exerted in changing the adjustment of the hanger bracket 35.

It is also to be realized that a single one of the retainer structures 64 could be employed to engage and retain a single one of the key members 74. In such a deviation from the preferred embodiment, a lateral stability of the anger bracket 35 tends to be less with respect to that of the described structure. Increasing the width of the ears 65 overcomes in part such a reduction in lateral support. A forward pivotal support of the hanger bracket 35 is also reduced when only one point of engagement is used. However, locating the hanger bracket 35 by the retaining engagement of only one selected one of the key members 74 with a respectively single retainer structure 64 is considered to be a possible modification within the scope of this invention.

The front edge 71 of the hanger bracket 35 is also shaped or modified from a straight line by a plurality of equally spaced hanger hook retainer recesses, designated generally by the numeral 76. The spacing or pitch between adjacent ones of the recesses 76 is preferably less than the spacing between the notches 73 into the hanger bracket 35 along its rear edge 72. The key members 74 are intended to permit a gross vertical adjustment of the hanger bracket 35 with respect to the board 12 in preparation for steaming long garments, such as the garment 37 (See FIG. 1), short garments, such as jackets, or garments of intermediate length, such as skirts. However, while one may have prepared for the steaming of garments of a such a predetermined length, exceptions may require some small vertical adjustment. Also, during the steaming of a single garment wrinkles at opposite extremities of such garment may be noticed, in which case the ability to quickly reposition a garment is of great convenience. The hanger hook retainer recesses 76 are intended to facilitate positioning a selected garment, such as garment 37, in such a position in front of the board 12, that the areas of the garment 37 which need to be steamed are conveniently located without excessive reaching or stooping. Thus, the retainer recesses 76 are available for quick, vertical adjustments of the garment 37 during steaming operations, and toward that purpose, each of the hanger retainer recesses 76 has an upwardly pointing lip 77 on its lower edge 78. The lip 77 retains the hook of a hanger 38 that may be placed into the respective recess 76. The convenient spacing of the hanger hook retainer recesses 76 is chosen to be one inch along the front edge 71 of the hanger bracket 35.

The front edge 71 and, consequently, the recesses 76 therein are in the preferred embodiment disposed at a slope with respect to the vertical, in that the spacing between the front edge 71 and the rear edge 72 is greater at the top end 68 of the hanger bracket 35 than at the bottom end 69 thereof. While the resulting negative slope of the front edge 71 of the hanger bracket 35 is not essential, it is considered advantageous to have the lower portions of the front edge 71 slightly recessed from the hanger 38 and from the garment 37 thereon, when the hanger 38 is suspended by one of the upper recesses 76.

The bottom end 69 of the hanger bracket 35 features a larger aperture 81 without an opening or breakthrough to either the front or rear edges 71 or 72 of the bracket 35. This larger aperture is provided for convenience to be engaged by any specialty hanger that may not otherwise fit the recesses 76. Some types of commercially available molded plastic hangers (not shown) could be considered for use with the aperture 81.

FIG. 3 shows the steam board assembly 10 with the hanger bracket 35 in its lowermost position. In this position of the hanger bracket 35, it is possible to suspend a garment shorter than the garment 37 (See FIG. 1) in front of the board 12 and completely within the confines defined by the extent of the front surface 44 of the board 12.

FIG. 4 shows an alternate embodiment of the invention, and particularly a modified upper end portion 84 of the mounting bracket 14. The modified end portion 84 shows a planar continuation of the elongate body portion of the mounting bracket 14 to its upper end. Mounting holes 85 are formed adjacent the upper end into the upper end portion 84 with mounting screws 86 inserted through such mounting holes 85 to fasten the steam board assembly to a surface of a straight wall (not shown). While such alternate embodiment still incorporates other features of the invention, the alternate embodiment does not permit the same ready placement or removal of the steam board 10 from the door 23 shown in FIG. 1. FIG 4 also shows a detail of a threaded portion 88 which engages a complementary thread in the respective aperture 89 of an adjacent ear 90 of a thus modified retainer structure 91.

FIG. 5 shows an alternate embodiment of a hanger bracket which is designated generally by numeral 92. Instead of the straight bar type shape of the hanger bracket 35, the alternate shape is a formed piece with a projection or cross section in the shape of a "V", as depicted in FIG. 6. The "V"-shape establishes the rear surface 72 in the form of the top edges of the "V", while the front surface 71 is defined by the bottom of the "V".

The alternate shape of the hanger bracket 92 necessitates a modification of the mounting bracket 14 and particularly of the retainer structures 64. FIG. 6 shows a modified retainer structure 93 in which a centered support 94 is staked or otherwise attached to extend perpendicularly from the front surface 63 of the mounting bracket 12. A retainer pin 95 is resistance-welded, brazed or otherwise fastened in a known manner through a locating aperture 96 in the support 94 to establish the predetermined gap 75 between the front surface 63 of the mounting bracket 12 and the adjacent surface of the retainer pin 93. The gap 75, as described above with respect to the preferred embodiment, receives the respective key members 74 at now both respective rear edges 72 of the alternate hanger bracket 92 to become retained between the front surface 63 and the retainer pin 95. The hanger hook retainer recesses 76 are now formed in the bottom 98 of the "V", as the equivalent of the front edge 71 of the hanger bracket 35.

From the aforegoing detailed description of the preferred embodiment of the invention and a description of desirable modifications thereof, it is to be recognized that the described and other changes and modifications are possible in the preferred embodiment without departing from the spirit and scope of the invention. This invention is to be defined and limited only by the scope of the claims appended hereto.

What is claimed is:

1. A steam board with adjustable garment support comprising:

a rigid board having front and back surfaces;

a mounting bracket having an elongate body portion and upper and lower ends located t opposite ends of the body portion, the body portion having first and second major surfaces, the lower end of such body portion attached to the back surface of the board adjacent an edge of the board with the first major surface of the body portion facing the back surface of the board, said body portion extending from said attachment beyond and away from said edge of the board, the mounting bracket including means for mounting the steam board to a further surface;

a garment hanger bracket having top and bottom ends and front and rear surfaces, said front and rear surfaces extending substantially the length of the garment hanger bracket, a plurality of spaced recesses formed along and into the front surface of the garment hanger bracket, such recesses adapted to receive and retain the hook of a garment hanger, and a plurality of key members formed along the length of and defining the shape of said ear surface of the garment hanger bracket, each of said key members being attached to and part of said garment hanger bracket at an end toward the top end of the garment hanger bracket and extending such end toward the top end substantially in parallel to the rear surface toward the bottom end of the garment hanger bracket; and means for receiving at least one selected one of the key members of the garment hanger bracket in retaining engagement, said receiving means located on the first major surface of the body portion of said mounting bracket adjacent said upper end of said body portion of said mounting bracket, whereby the position of said at least one key member determines the distance at which the garment hanger bracket will be located with respect to the board when said at least one key member is in such retaining engagement and steam applied to portions of a garment hanging in front of the rigid board is blocked from contacting said further surface by the rigid board being located between said further surface and the garment portions when the steam board is mounted to said further surface and the garment is suspended from said garment hanger bracket of the steam board.

2. A steam board according to claim 1, wherein the receiving means comprises two retainer structures, said structures being spaced in the direction of the longitudinal extent of said mounting bracket and by a distance equal to the spacing of adjacent ones of the key members of the garment hanger bracket, and wherein said two retainer structures are adapted to simultaneously receive in retaining engagement vertically disposed ones of the key members of the garment retainer bracket.

3. A steam board according to claim 2, wherein the hanger bracket is a substantially straight bar, the thickness of the bar determining the width of said front and rear surfaces, and wherein each of the retainer structures comprises two ears extending in juxtaposition from the front surface of said mounting bracket, said ears being spaced from each other by a gap of a size defined by inner, facing surfaces of such ears being separated substantially by the thickness of said bar, a retainer pin being securely mounted in said gap and bridging said gap, said retainer pin mounted at a predetermined distance from a adjacent surface portion of said mounting bracket to receive a selected key member in the space defined by such adjacent surface portion of the mounting bracket and said retainer pin.

4. A steam board according to claim 2, wherein the rigid board is a rectangular sheet of plywood which further comprises an inner sheet of resilient and loosely matted polyester material covering the front surface of the board, and an outer sheet of woven material covering the inner sheet, said outer sheet wrapping around the edges of the plywood and fastened to the back surface of the plywood, the woven material having openings between the weave to permit impinging steam to penetrate through spaces of the weave.

5. A steam board according to claim 4, wherein a plurality of resilient feet are mounted in spaced relationship to the rear surface of the board, and wherein said mounting means of the mounting bracket includes a support member formed at the upper end of the mounting bracket and extending substantially perpendicularly from the second major surface of the mounting bracket, and a ledge formed in parallel to the second major surface of the mounting bracket at the end of the support member and spaced from said second major surface by a thickness of a standard door, whereby the steam board is adapted to be suspended from the top of a door, and mounting the steam board to a surface includes suspending the steam board from the top of a door to locate the suspended steam board in suspension adjacent the surface of such door, such resilient steam board with respect thereto.

6. A steam board according to claim 4, wherein a plurality of resilient feet are mounted in spaced relationship to the rear surface of the board, and wherein such mounting means of the mounting bracket comprises a planar end portion at the upper end of the mounting bracket, and a plurality of mounting holes formed through such planar end portion, whereby the steam board is adapted to be mounted to the surface of a wall, said resilient feet resting in contact with the surface of such wall and stabilizing the steam board with respect to the surface of the wall.

7. A steam board with adjustable garment support comprising:

a rectangular board having front and back surfaces;

a mounting bracket, having an elongate body portion with front and back surfaces and first and second end portions at opposite ends of the longitudinal extent of the mounting bracket, the mounting bracket being attached at the first of the end portions to the back surface of the board adjacent the center of a top edge of the board, and with the front surface of the mounting bracket facing the back surface of the board, the mounting bracket extending from such end portion in parallel with the back surface of the board and away from the board with an orientation in which a projection of the mounting bracket along its length is substantially aligned with the centroid of the board, and means for mounting the board and mounting bracket to a further surface, such mounting means located at the second end portion of the mounting bracket;

a garment hanger bracket having top and bottom ends and front and rear edges, the front edge having a plurality of hanger hook retainer recesses spacedly disposed along such front edge, each such recess having an upwardly pointing lip on its lower edge when the hanger bracket is vertically disposed with the top end at the top, such lip capable of retaining a coat hanger hook inserted into such recess, the rear edge of the hanger bracket having a plurality of "L"-shaped notches, such notches equally spaced along the rear edge and extending from said rear edge into the hanger bracket, the closed end of each notch directed toward the top end of the hanger bracket, each of said "L"-shaped notches defining a key member; and a support structure attached to the front surface of the body portion of the mounting bracket, the support structure including a support extending from the front surface of said body portion and means for retaining the key members in bracket-supporting engagement, such key retainer means supported at a predetermined space from the front surface of said body portion, adapted to receive key members in bracket-supporting engagement between the front surface of the body portion and the key retainer means, such that a bracket-supporting engagement of first selected key members between the front surface of the body portion and the key retainer defines a first adjusted mounting position of the hanger bracket relative to the board, said hanger bracket adapted to occupy a plurality of such adjusted mounting positions by the selection of key members other than the first selected key members for locking engagement between the front surface of the body portion and the key retainer, whereby steam applied to portions of a garment hanging in front of the rectangular board is blocked from contacting said further surface by the rectangular board being located between said further surface and the garment portions when the steam board is mounted to said further surface and the garment is suspended from said garment hanger bracket.

* * * * *

UNITED STATES PATENT AND TRADEMARK OFFICE

CERTIFICATE OF CORRECTION

PATENT NO. : 4,894,935

DATED : January 23, 1990

INVENTOR(S) : David C. Kretz

It is certified that error appears in the above-identified patent and that said Letters Patent is hereby corrected as shown below:

The title page should be deleted to appear as per attached title page.

The sheets of drawings consisting of Figs. 1-6, should be deleted to appear as per attached pages.

United States Patent [19]

Kretz

[11] Patent Number: 4,894,935

[45] Date of Patent: Jan. 23, 1990

[54] STEAM BOARD WITH ADJUSTABLE GARMENT SUPPORT

[76] Inventor: David C. Kretz, 3533 Heather Ridge Dr. NE, Cedar Rapids, Iowa 52402

[21] Appl. No.: 332,045

[22] Filed: Apr. 3, 1989

[51] Int. Cl.[4] ..... D06C 3/00

[52] U.S. Cl. ..... 38/137; 38/104; 223/69; 223/DIG. 4; 248/214

[58] Field of Search ..... 248/214; 38/102, 104, 38/112, 137; 223/69, 70, DIG. 4, DIG. 2

[56] References Cited

U.S. PATENT DOCUMENTS

| | | | |
|---|---|---|---|
| 465,864 | 12/1891 | Krause . | |
| 2,599,199 | 6/1952 | Roberts | 223/69 |
| 2,854,178 | 9/1958 | McDowall et al. . | |
| 3,066,839 | 12/1962 | Dosal . | |
| 3,264,755 | 8/1966 | Moore . | |
| 3,442,426 | 5/1969 | Kannegiesser et al. . | |
| 3,477,155 | 11/1969 | Feld et al. . | |
| 3,486,668 | 12/1969 | Feld et al. | 223/69 |
| 3,752,373 | 8/1973 | Smith . | |
| 3,989,213 | 11/1976 | Allen | 248/214 |
| 4,123,024 | 10/1978 | Levy | 248/214 |
| 4,303,183 | 12/1981 | Schlemon . | |
| 4,592,497 | 6/1986 | Georges . | |
| 4,613,066 | 9/1986 | Saucy . | |

*Primary Examiner*—Andrew M. Falik

*Attorney, Agent, or Firm*—Simmons, Perrine, Albright & Ellwood

[57] ABSTRACT

A board is vertically mountable to a wall or door and features an upwards extending support structure to which a garment hanger support bracket is attached. The garment hanger support bracket is itself vertically adjustable to permit hangers to be supported relatively higher or lower with respect to the board. A vertical adjustment of the bracket consequently allows respectively longer or shorter garments to be hung in a substantially centered position in front of the board. In addition the garment hanger support bracket features a plurality of vertically spaced hanger support recesses which allow a garment to be vertically relocated during a steaming operation without the need to vertically readjust the garment hanger support bracket itself. This latter feature permits a garment to be vertically shifted to bring wrinkles in upper and lower portions of the garment to a convenient working height.

7 Claims, 2 Drawing Sheets

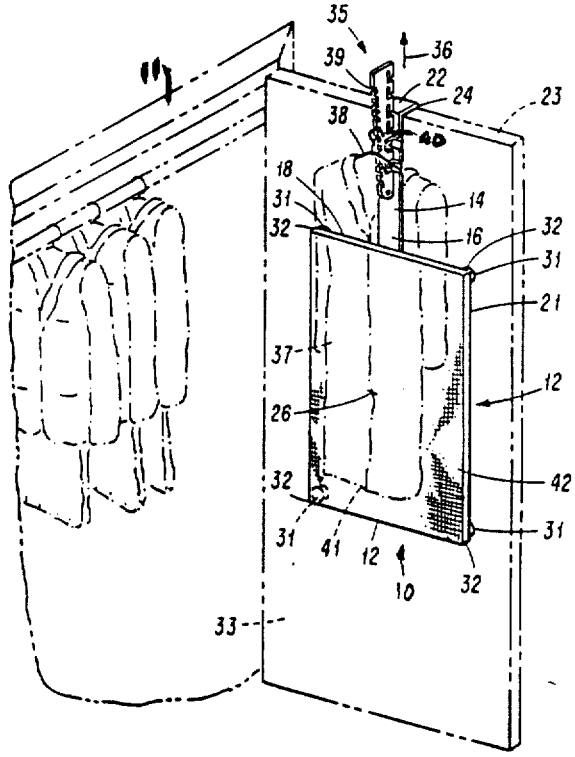

FIG 1
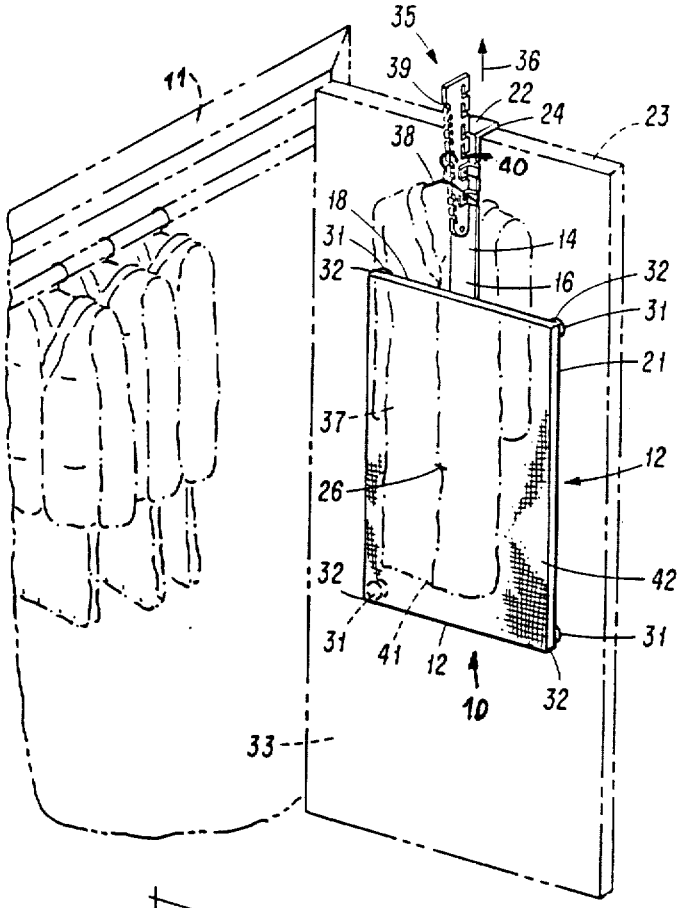
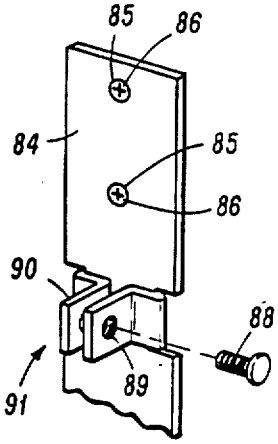
FIG 4
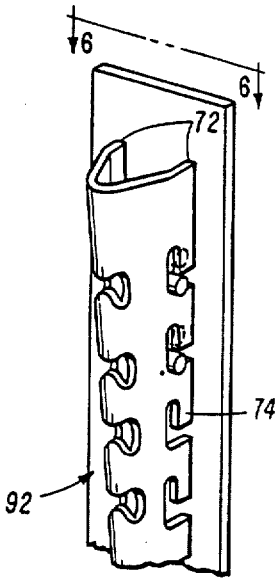
FIG 5
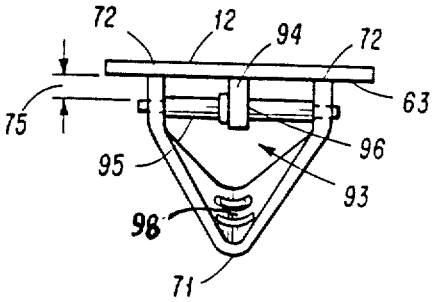
FIG 6

UNITED STATES PATENT AND TRADEMARK OFFICE

CERTIFICATE OF CORRECTION

PATENT NO. : 4,894,935

DATED : January 23, 1990

INVENTOR(S) : David C. Kretz

It is certified that error appears in the above-identified patent and that said Letters Patent is hereby corrected as shown below:

Column 4, Line 43

Change "sheet 46 to outwardly", to --sheet 46 to escape outwardly--.

Column 6, Line 39

Change "anger bracket 35", to --hanger bracket 35--.

Column 8, Line 29

Change "located t opposite ends", to --located at opposite ends--.

Column 8, Line 48

Change "shape of said ear surface", to --shape of said rear surface--.

Signed and Sealed this

Eleventh Day of February, 1992

*Attest:*

*Attesting Officer*

HARRY F. MANBECK, JR.

*Commissioner of Patents and Trademarks*